US006726196B2

(12) United States Patent
Kirino

(10) Patent No.: US 6,726,196 B2
(45) Date of Patent: Apr. 27, 2004

(54) SHEET POST-PROCESSING DEVICE AND IMAGE-FORMING DEVICE

(75) Inventor: Koji Kirino, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/312,687

(22) PCT Filed: Jul. 4, 2001

(86) PCT No.: PCT/JP01/05786

§ 371 (c)(1),
(2), (4) Date: Dec. 30, 2002

(87) PCT Pub. No.: WO02/02449

PCT Pub. Date: Jan. 10, 2002

(65) Prior Publication Data

US 2003/0143006 A1 Jul. 31, 2003

(30) Foreign Application Priority Data

Jul. 4, 2000 (JP) ..... 2000-202354

(51) Int. Cl.[7] ..... B65H 37/04; B65H 31/34

(52) U.S. Cl. ..... 270/58.11; 270/58.14; 270/58.08; 399/410

(58) Field of Search ..... 270/58.08, 58.09, 270/58.1, 58.11, 58.12, 58.13, 58.14; 399/410

(56) References Cited

U.S. PATENT DOCUMENTS 5,478,062 A * 12/1995 Horiuchi et al. ..... 270/58.08
6,098,975 A * 8/2000 Kobayashi ..... 270/58.09
6,145,825 A * 11/2000 Kunihiro et al. ..... 270/58.09
6,302,389 B1 * 10/2001 Kato et al. ..... 270/58.13
6,305,681 B1 * 10/2001 Watanabe et al. ..... 270/58.08
6,427,997 B1 * 8/2002 Hirota et al. ..... 270/58.12

FOREIGN PATENT DOCUMENTS

JP 5-223572 8/1993
JP 7-94129 4/1995

* cited by examiner

*Primary Examiner*—Patrick Mackey
(74) *Attorney, Agent, or Firm*—Osha, Novak & May L.L.P.

(57) ABSTRACT

This invention relates to a sheet post-processing device and an image-forming device. The mechanism that arranges sheets to be a bundle and that discharges the bundle will be reduced in size and cost. A sheet S1 guided by the guide 44 is conveyed to a tray 12 by a discharging roller 21. When the rear end α of the sheet S1 locates on a arranging table 41, the discharging roller 21 rotates in the opposite direction, and the sheet is conveyed until the sheet contacts the stopper 43 of the arranging table 41. The next sheet S2 is conveyed to the tray 12 in the same manner as previous described, however the previous sheet S1 is held on the arranging table by the holding device 51. The sheet S2 contacts the stopper 43 by the reverse rotation of the discharging roller 21 to be arranged on the sheet S1. A bundle of sheets bound by a stapler 60 is discharged to the tray 12 completely by the discharging roller 21.

12 Claims, 22 Drawing Sheets

SHEET POST-PROCESSING DEVICE AND IMAGE-FORMING DEVICE

TECHNICAL FIELD

This invention relates to a sheet post-processing device and an image-forming device.

BACKGROUND ART

In many cases a sheet post-processing device for piling up and positioning two or more sheets of paper, and for binding the sheets by staples is added to an image-forming device, such as a copying machine, a printer, and a facsimile to discharge a paper bunch on a tray. There are some examples of such sheet post-processing device written in the Provisional-Publication or Kokai Publication No. 2-144370 and the Provisional-Publication or Kokai Publication No. 1-313261. The device written in the publications has a tray separated from the passage of the sheets in the post-processing device. Along the paper discharge direction the upstream portion of the tray is located in lower position than the downstream portion of the tray.

Accordingly, the post-processing device such as prior arts must be larger and expensive, because the tray is separated from the passage of the sheets and the height of the tray largely increases from upstream portion to the downstream portion along the paper discharge direction. And the device sometimes needs an auxiliary belt conveyor between the passage of sheets in the device and the tray in order to prevent the device from dropping the sheets between the passage and the tray during a series of the dealing with the sheets of paper, because the tray is largely separated from the passage. The auxiliary conveyor makes the device larger and more expensive.

DISCLOSURE OF THE INVENTION

This invention was made, after taking the above situations into consideration, the first purpose of this invention is to offer a sheet post-processing device being small and cheap as a whole.

The second purpose of this invention is to offer the image-forming device with the above-mentioned sheet post-processing device.

In order to attain the first purpose of the invention, the following solution techniques are adopted:

A sheet post-processing device for discharging the sheets on a tray as a paper bunch after piling-up and positioning the received sheets comprising:

- a conveyance means for conveying the sheets along the predetermined direction which is changeable;
- a tray for arranging and loading a paper bunch; and
- a holding means for holding a paper bunch tightly;
- wherein the holding means is operated when the conveyance means conveys the sheets in the paper discharging direction and is released when the conveyance means conveys the sheets in the paper taking-in direction.

According to the above-mentioned solution technique, the paper received by the conveyance means is conveyed to the tray in the paper discharge direction, however, is turned to the reverse direction to the pilling-up position in the middle of the passage and the back end (the end in the paper discharge direction) of a paper reaches to the pilling-up position. At this position the paper is held by the holding means tightly. The next coming paper is also operated by the conveyance means, however the former sheet or sheets of paper being held by the holding means stay at the piling-up position, while the conveyance means conveys the next paper to the tray in the paper discharging direction. When the predetermined number of sheets of paper are piled up at the piling-up position in this manner to form a paper bunch, the holding function of the holding means will be released and the paper bunch will be conveyed in the paper discharging direction by the conveyance means while the holding means is released.

When the predetermined number of sheets of paper are piled up at the piling-up position, the sheets can be bound by a stapler. To convey the paper in the opposite direction against the paper discharging direction and to position the back end of sheets correctly at the piling-up position, a leading guide which leads the paper from a upper position to a lower position is disposed along the passage of paper formed by the conveyance means, and an arranging support which stretches almost horizontally in the opposite direction against the paper discharging direction from the lower position of the passage is disposed under the leading guide to pile up the back end of the sheets on the arranging support. It may be desirable to form on the end of the arranging support a stopper for positioning the back ends of the sheets.

It is desirable for the conveyance means to have a variable conveyance ability, since the thickness and weight considerably differ from a sheet of paper by a paper bunch. For example, in case the conveyance means is composed of a pair of rollers pinching a sheet or sheets, the power of pinching the sheets by the rollers is changed according to a sheet or sheets. (For example, one roller's pressing force against the other roller is changed.) A plural roller having a common shaft may be composed of rollers having a large outer diameter and rollers having a small outer diameter, and only rollers having a large diameter will be on a sheet of paper when the sheet is conveyed and both large and small rollers will be on a paper bunch when the bunch is conveyed, wherein the rollers having a large diameter may be made of the soft material being elastic deformable. The diameter of large rollers will be compressed in the direction of the diameter by a paper bunch, when the bunch is conveyed. In order to compress the diameter of the large rollers, it is also possible to set the conveyance means so as to have at least two positions, for example. It is desirable to set the difference between the diameter of the large rollers and that of the small rollers to be more than twice of the thickness of the paper bunch (i.e. the maximum permissible thickness) so that the small rollers do not contact with the bunch when the large rollers are not compressed.

An image-forming device to achieve the second object comprises a previously described sheet post-processing device. The objects of this invention should not be limited to the above-mentioned objects, and include tacitly providing the object described as being substantially preferable or advantageous.

BEST MODES FOR CARRYING OUT THE INVENTION

Figure 1:
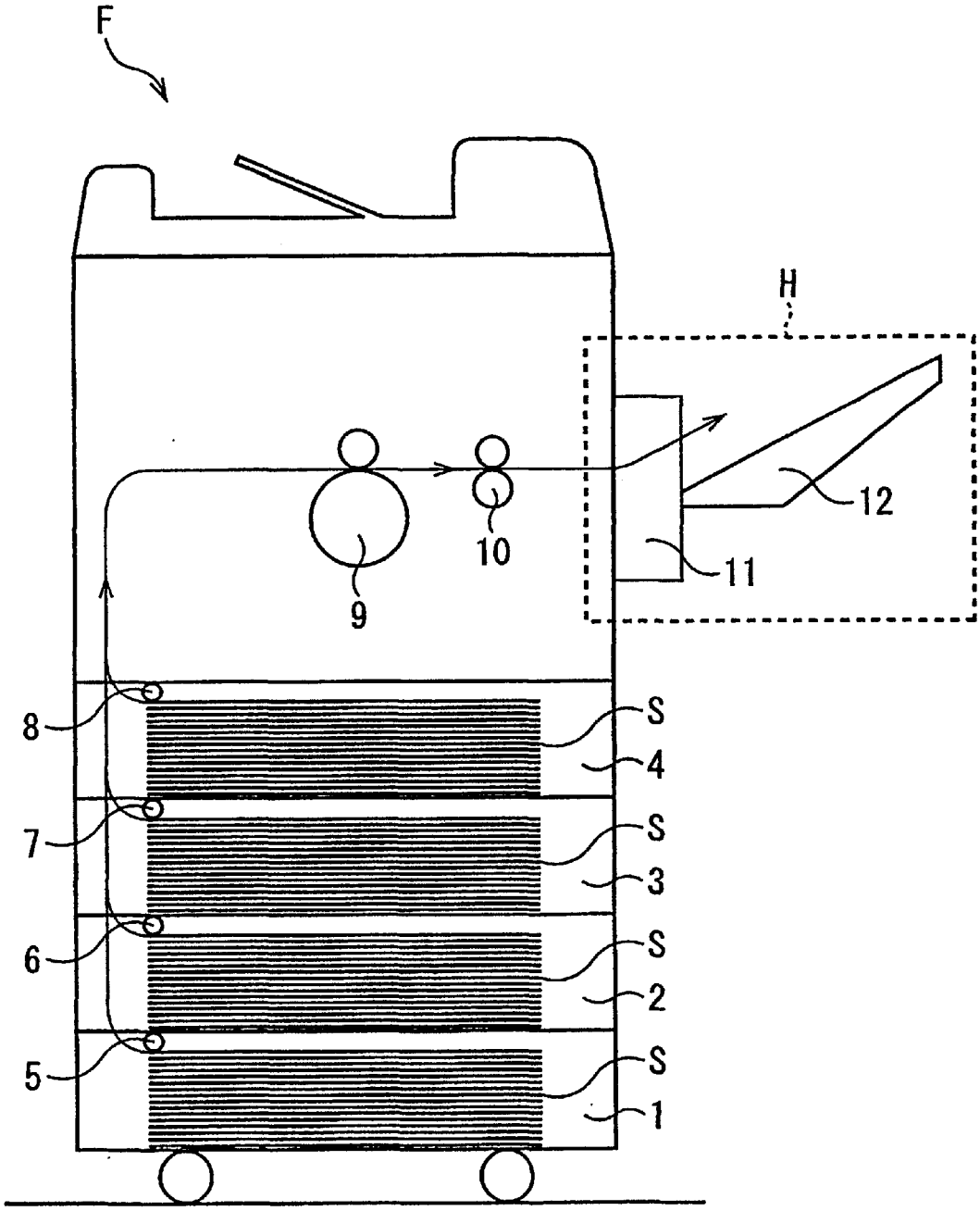
FIG. 1 is an illustration of simple side view system showing an example when the present invention is applied to an image-forming device.

FIG. 1 shows an example of an image-forming device F (i.e. a copying machine in this embodiment) that the present invention was applied to. The parts shown by the numbers 1–4 in the FIG. 1 are storage spaces of sheets of paper S. A sheet of paper S sent off by conveying rollers 5, 6, 7 or 8 from the selected one of storage spaces 1–4 is supplied to a transcription drum 9. An image is formed on the sheet of paper S by the transcription drum 9, and the image on the sheet of paper S is heated by the fixing roller to be fixed on the paper S. The paper S is conveyed to a tray 12 through a sheet post-processing mechanism 11 from the fixing roller 10. The sheet post-processing mechanism 11 and the tray 12 compose a sheet post-processing device H.

Figure 2:
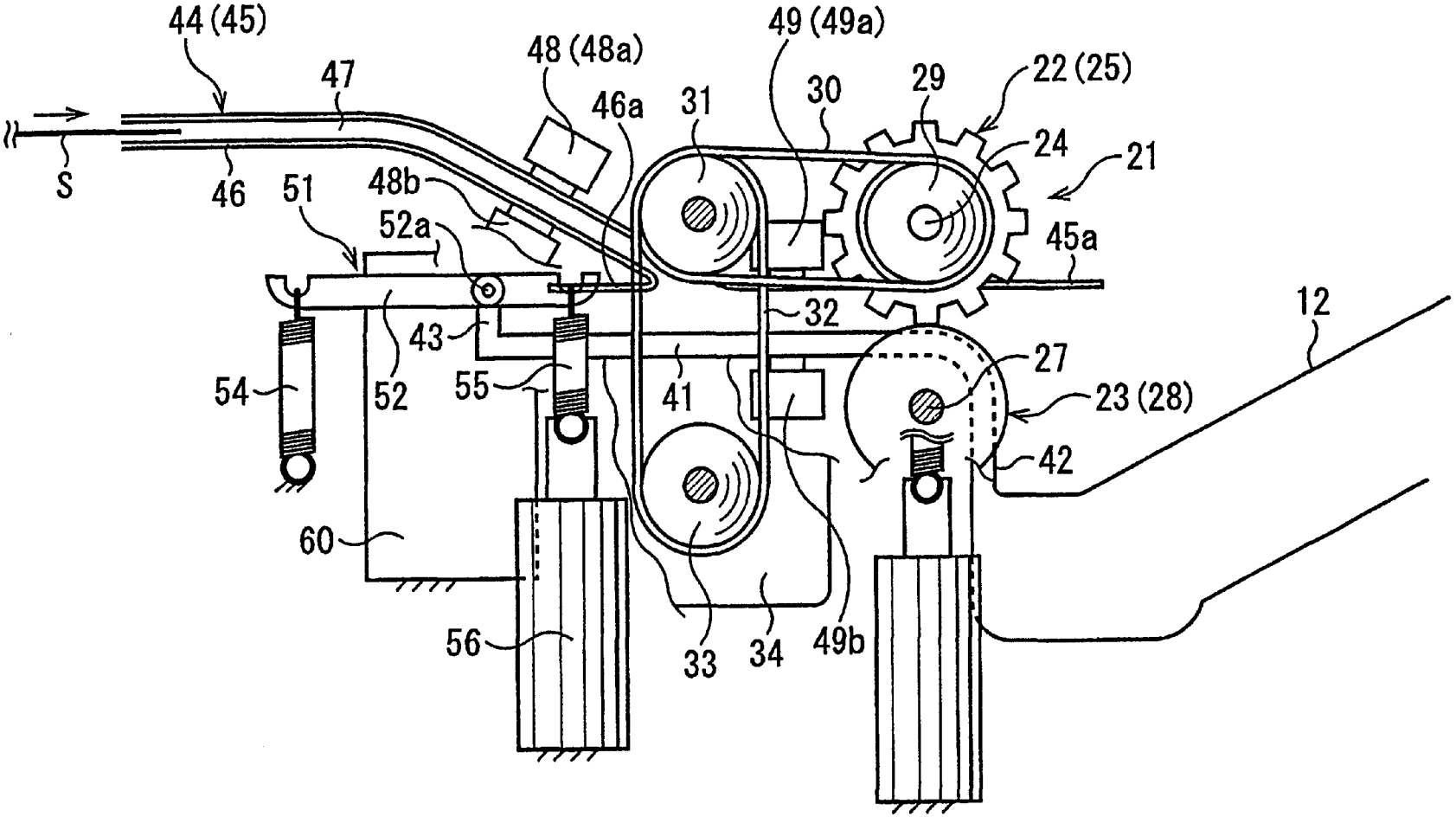
FIG. 2 is a side view showing features of a paper post-processing device.
Figure 3:
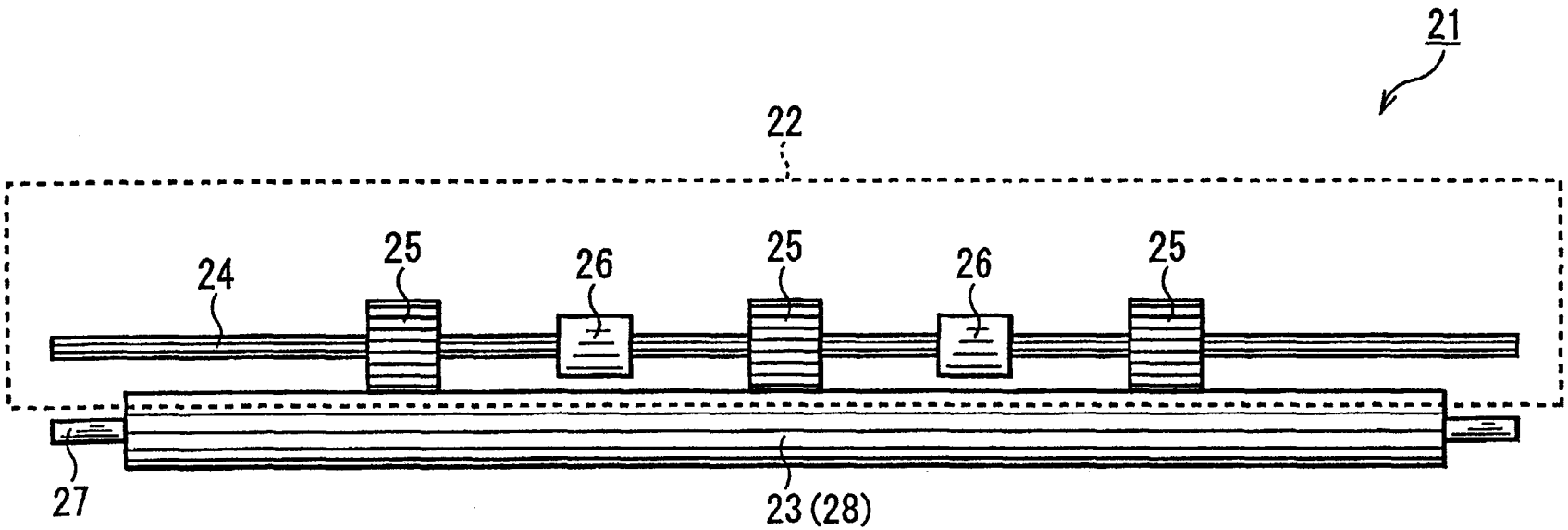
FIG. 3 is a front view showing one example of conveyance means considered to be a roller type.

An embodiment of the sheet post-processing device H is shown in FIG. 2. The part shown by the number 21 is a discharging roller device as a conveyance means for sheets. The discharging roller device 21 has a driving roller portion 22 and an idle roller portion 23. The driving roller portion 22 has a driving shaft 24 stretched almost horizontally, and first and second driving rollers 25 and 26 fixed to the driving shaft 24, as shown in FIG. 3. The first driving rollers 25 are made of soft materials easily elastically deformed, such as a rubber, sponge, soft rubber, etc. The outer circumferential surface of the roller 25 makes gear shape with many protrusions and depressions formed at equal intervals around the circumference. The second driving roller 26 is made of harder materials, in comparison with those of the first driving rollers 26, such as hard rubber that generates the high frictional force. The outer diameter of the second driving rollers 26 is set to be smaller than that of the first driving rollers 25.

Figure 4:
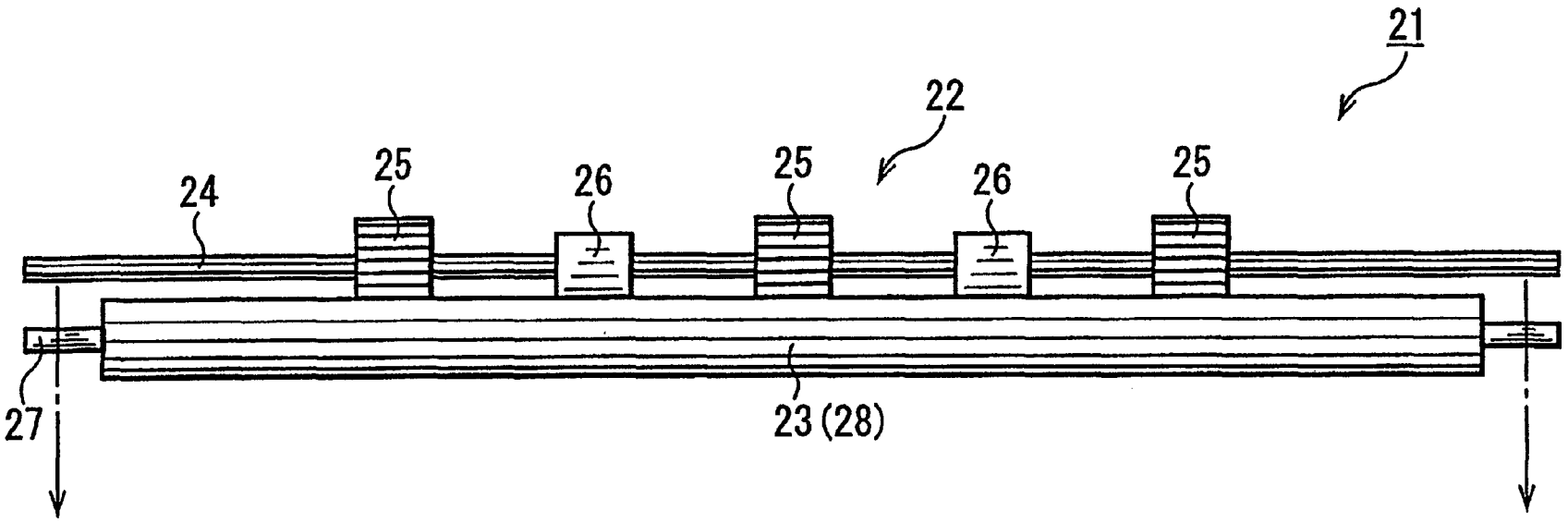
FIG. 4 is a front view showing the state that driving rollers having a large diameter are compressed in the direction of the diameter from the state of FIG. 3.
Figure 5:
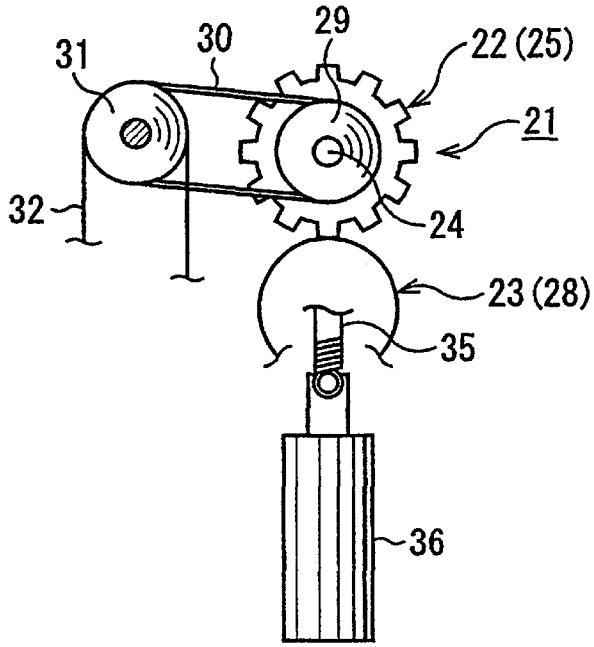
FIG. 5 is a side view of FIG. 3 including a driving mechanism of rotating rollers and moving them in the direction of their shaft.
Figure 6:
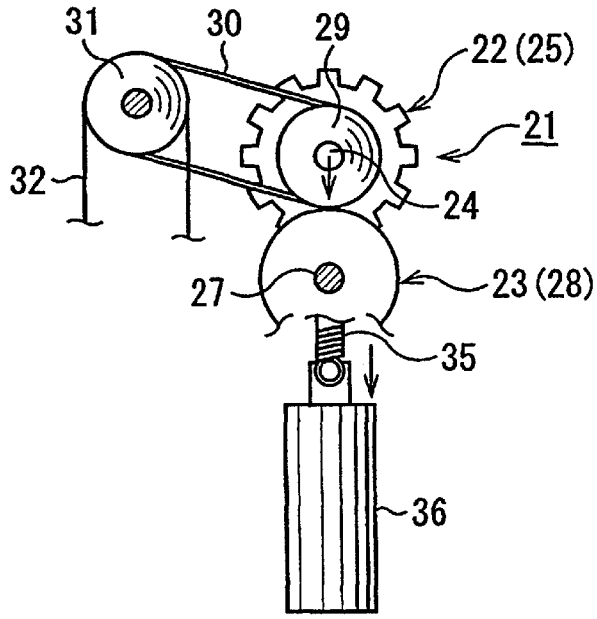
FIG. 6 is a side view of FIG. 4 including a driving mechanism of rotating rollers and moving them in the direction of their shaft.

The idle roller portion 23 has a rotating shaft 27 in parallel to the driving shaft 24, and a cylindrical idle roller 28 fitted on the shaft 27. The roller 28 is usually in contact with the first driving rollers 25 having a larger diameter, however, is out of contact with the second driving rollers 26 having a small diameter unless a large pressure adds to the second driving rollers 26 in the direction of the diameter (see FIGS. 3 and 5). The difference in diameter between the diameter of the first driving roller 25 and that of the second driving roller 26 is more than twice of the maximum thickness of the paper bunch. As described below, the driving shaft 24 is driven up and down. When the driving shaft 24 is forcibly displaced downward from the state shown in the FIGS. 3 and 5, the first driving rollers 25 having a large diameter is elastically deformed (or compressed in the direction of the diameter), and the second driving rollers 26 having a small diameter also contact with the idle roller 28 as shown in the FIGS. 4 and 6. In this case the conveyance ability is larger than that in the case of conveying a sheet or sheets of paper by only the first driving rollers 25 having a large diameter (as shown in the FIGS. 3 and 5). The rotating shaft 27 may be displaced upward instead of displacing the driving shaft 24 downward.

The driving roller portion 22 or the driving shaft 24 is rotated, through a pulley 29, a belt 30, an idle pulley 31, a belt 32, and a pulley 33, by the driving motor 34. The shaft 24 is connected to a solenoid 36 through a spring 35. When the solenoid 36 is in OFF state, the state of the shaft 24 is shown in the FIGS. 3 and 5. When the solenoid 36 is in ON state, the state of the shaft 24 is pulled down through a spring 35 as shown in the FIGS. 4 and 6.

In the FIG. 2 the right hand direction of the discharging roller device 21 means the paper discharging direction, and the left hand direction of the discharging roller device 21 means the opposite direction against the discharging direction (hereinafter the "opposite direction" can be named "a predetermined opposite direction"). To the predetermined opposite direction from the discharging roller device 21, an arranging support 41 is almost horizontally stretched. The end of the arranging support 41 in the paper discharging direction is connected to a tray 12 through a short difference portion 42 in level, which is formed in an almost right angle. Disposed is the tray 12 whose position will be higher from the upper stream of the paper discharging direction to the lower stream of the direction, however, the slope degree of the tray is determined to be small, as shown in the FIGS. 9–21. At the end of the arranging support 41 in the predetermined opposite direction is formed the stopper 43 stretched to an upper direction shortly.

Over the arranging support 41, a guiding device 44 is disposed to guide a sheet of paper S to the discharging roller devise 21. The guiding device 44 is set to position gradually lower in proportion to approaching the discharging roller device 21. The guiding device 44 has an upper guide board 45 and a lower guide board 46, and the gap between the both guide boards 45 and 46 is formed as a guiding passage 47 of the sheet S. The upper guide board 45 stretches to the paper discharging direction through the side position of the discharging roller device 21 in approximately parallel to the arranging support 41 from the predetermined height of the upper guide board 45 facing the arranging support 41. (Needless to say, the upper board 45 may not stretch over the discharging roller device 21 to the paper discharging direction.) The lower guide board 46 stretches a little to the predetermined opposite direction in parallel to the arranging support 41 from the predetermined height.

At the position just before the arranging support 41 near the guiding device 44 is disposed a first detecting means 48 for detecting the carried sheet S. For example, the detecting means 48 consists of a light-emitting element 48*a* and a light-receiving element 48*b*. The light from the light-emitting element is received by the light-receiving element. The existence of the sheet S is detected by the detecting means 48, when the sheet S cuts off the light from the light-emitting element 48*a* to the light-receiving element 48*b*. At the position just before the discharging roller device 21 against the paper discharging direction is disposed a second detecting means 49 for detecting the sheet S. The second detecting means 49 also consists of a light-emitting element 49*a* and a light-receiving element 49*b*. The first and second detecting means 48 and 49 may consist of any other type of sheet detecting means.

Figure 7:
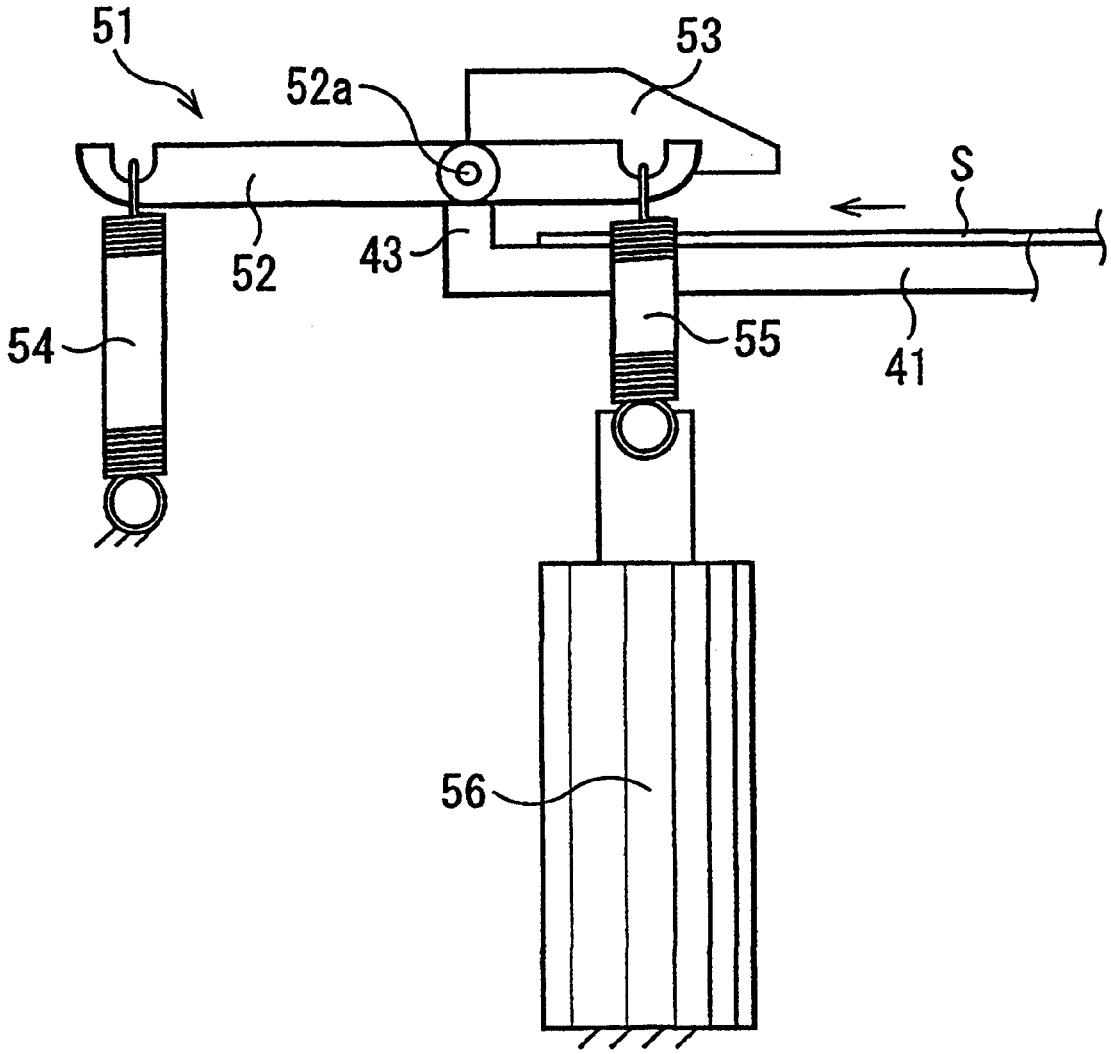
FIG. 7 is a side view showing the details of a holding apparatus of the released state from a pressing state in a sheet of paper.
Figure 8:
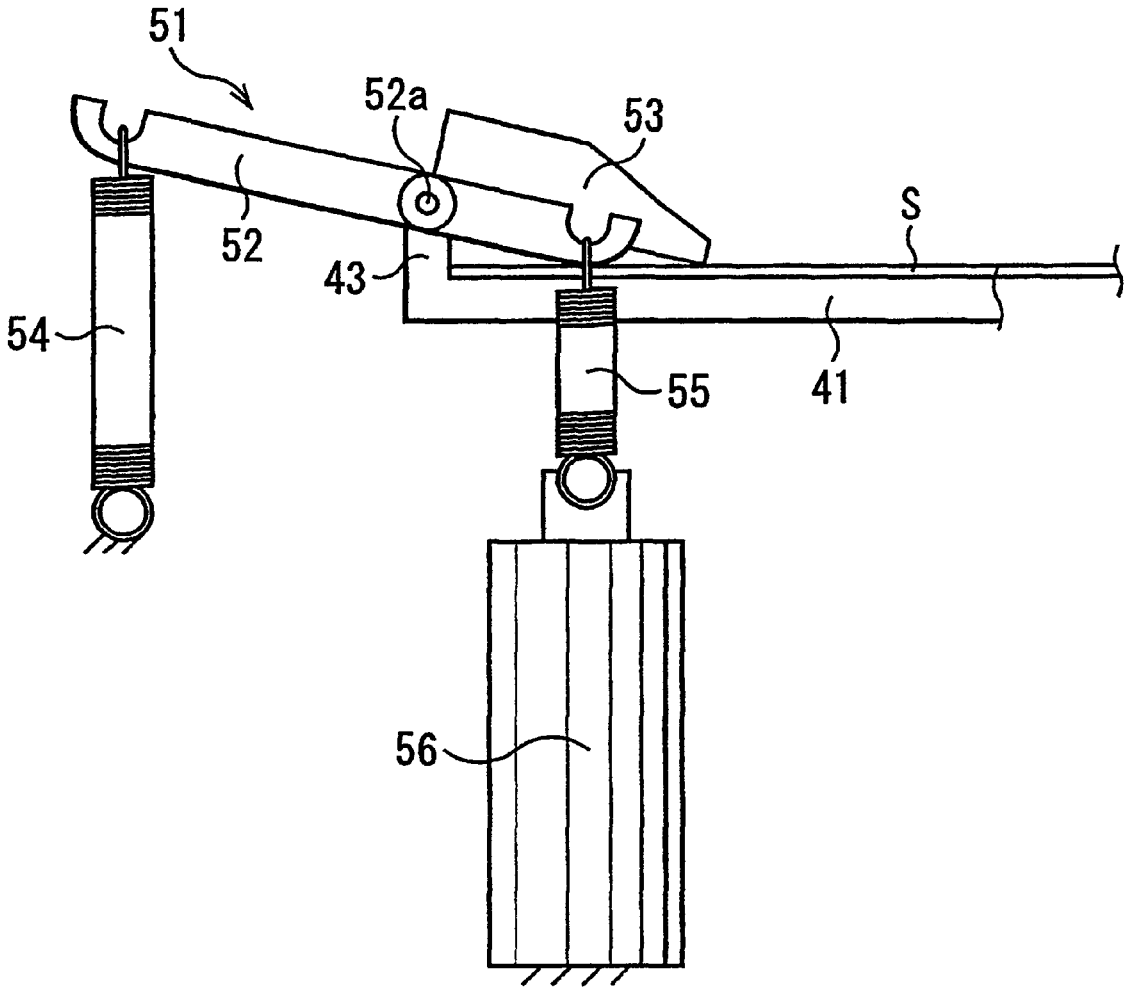
FIG. 8 is a side view showing the details of a holding apparatus of a pressing state of a sheet of paper.
Figure 9:
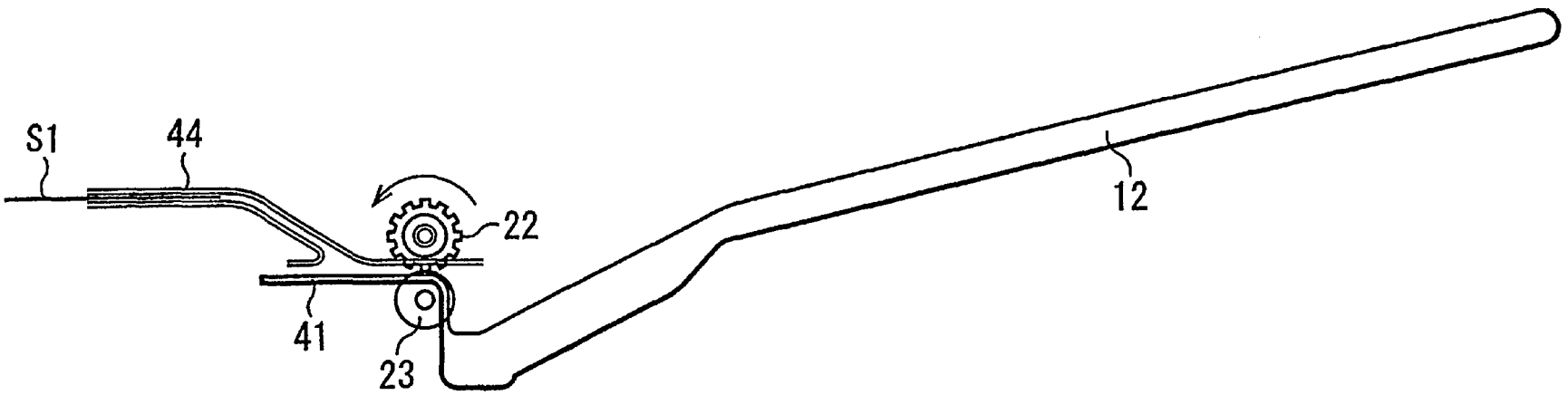
FIG. 9 is a simple side view of a paper conveyance state.
Figure 10:
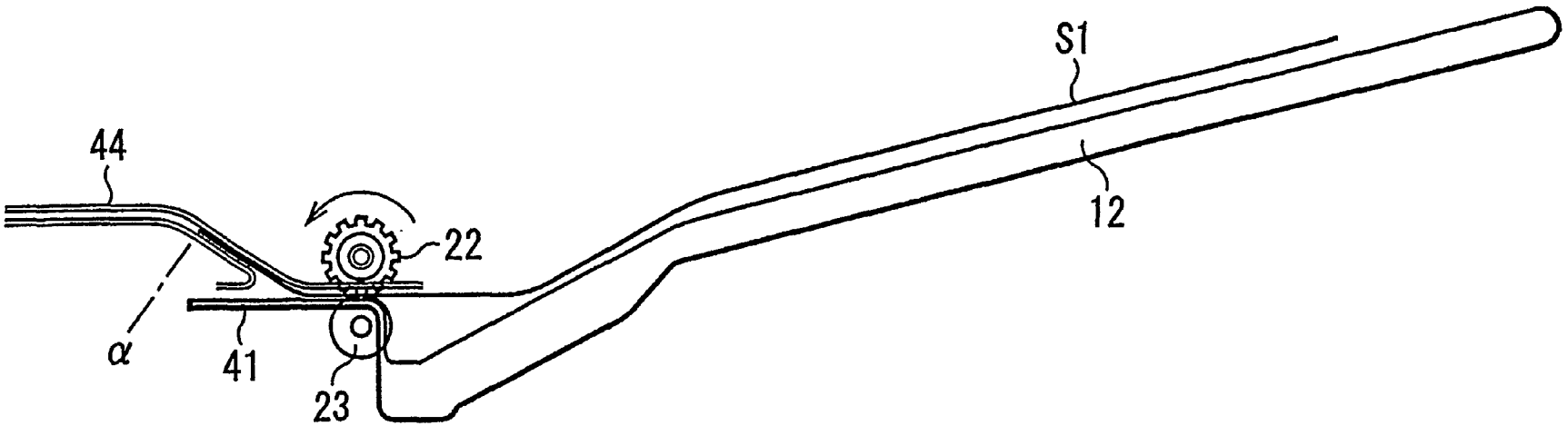
FIG. 10 is a simple side view of a paper conveyance state showing the state following FIG. 9.

At the end of the arranging support 41 in the predetermined opposite direction is disposed a sheet holding (or pinching) device 51, as shown in FIGS. 7 and 8. The holding device 51 has a swing lever 52 held pivotally around an axis as shown in cord 52*a* by the arranging support 41. The swing lever 52 stretches along the arranging support 41 to the discharging direction. The end of the swing lever 52 in the predetermined opposite direction is biased by a pulling spring 54. The other end of the swing lever 52 in the paper discharging direction is connected through a spring 55 to a solenoid 56. On the side of the swing lever 52 in the paper discharging direction is fixed a pushing member 53 for pinching and piling the sheets on the arranging support 41.

When the solenoid 56 is in the OFF state, the swing lever 52 stretches approximately horizontally as shown in the FIGS. 2 and 7 under the balance of springs 54 and 55. Then the pushing member 53 is in the release position over and far away from the arranging support 41 to release the function of holding sheets. When the solenoid 56 turns to the ON state, the swing lever 52 rotates in the clockwise direction in the FIG. 2 through the spring 55 pulled by the solenoid 56. Then the pushing member 53 is in the holding position to push the sheet or sheets on the arranging support 41 shown as in the FIG. 8. At the end of the arranging support 41 in the predetermined opposite direction is equipped the stapler 60 which binds the end of the sheets together.

The arrangement of a sheet or sheets and the discharge of a bunch of sheets are described below according to the FIGS. 9–21. At the beginning the driving rollers 25 having a large diameter are not deformed as shown in the FIGS. 3 and 5. From this state the sheet S1 is conveyed to the discharging roller device 21 through the guiding device 44. In the state, shown in the FIG. 9, which the fore end of the sheet S1 has not reached the arrangement support 41 yet, the driving roller portion 22 of the discharging roller device 21 is generated to begin rotation in the counterclockwise direction in the FIG. 9, which prepares to discharge the sheet. (The rotation direction is the discharging direction of the sheet.) The sheet S1 is conveyed to the discharging direction of the sheet by the discharging roller devise 21. Quite a long part of the sheet is on the tray 12 in the FIG. 10, and the rear end (whose location is marked as a in the figure) of the sheet S1 is still in the guiding device 44 and has not reached the arranging support 41 yet.

Figure 11:
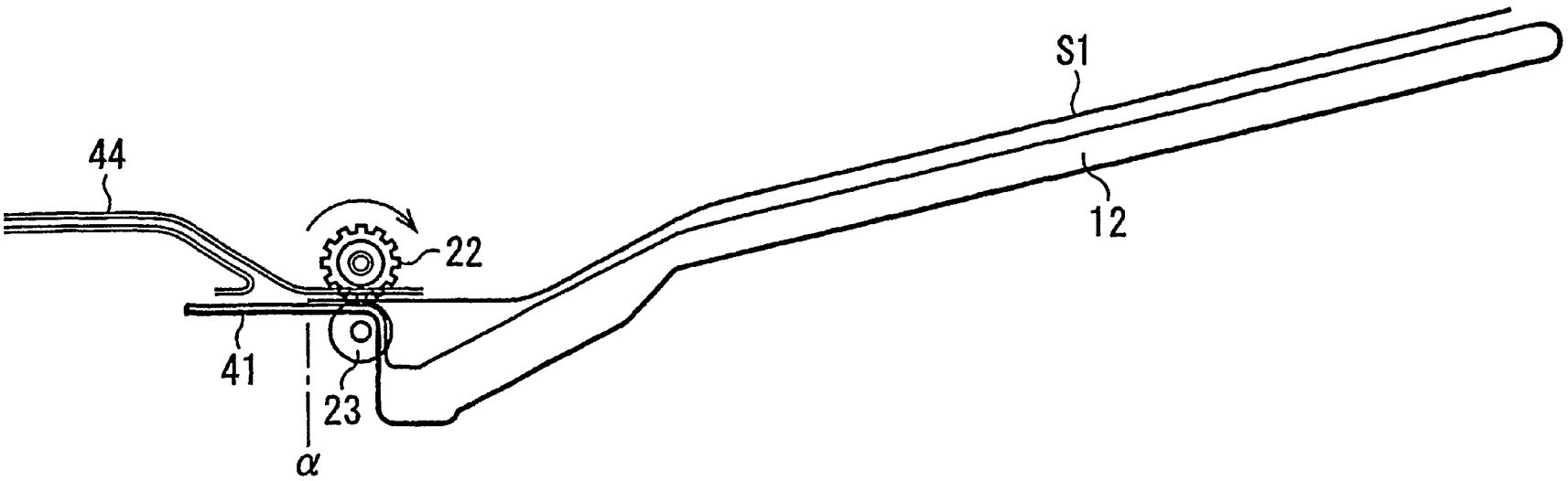
FIG. 11 is a simple side view of a paper conveyance state showing the state following FIG. 10.
Figure 12:
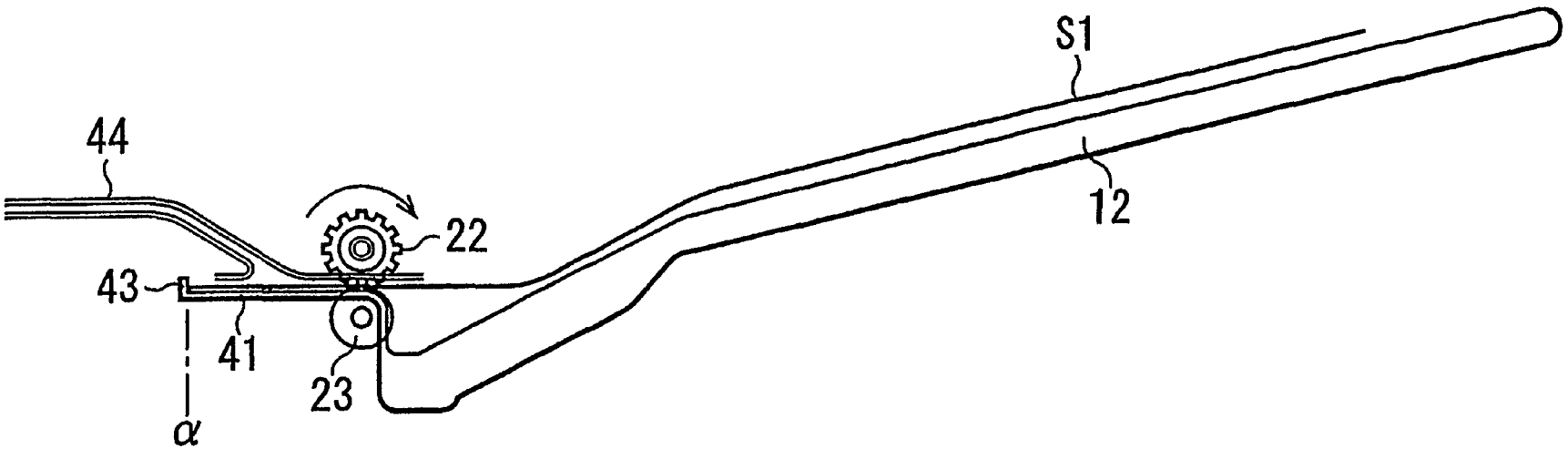
FIG. 12 is a simple side view of a paper conveyance state showing the state following FIG. 11.

The FIG. 11 shows the state in which the sheet S1 has been conveyed to the location that the rear end of the sheet is on the arranging support 41. (The state is detected under the conditions of the detecting means 48 detecting no sheet and of the detecting means 49 detecting a sheet.) From the state of the FIG. 11, the driving roller portion is rotated in the reverse direction. The sheet S1 is conveyed in the predetermined opposite direction on the arranging support 41. By the conveyance of the sheet in the predetermined opposite direction, the rear end of the sheet S1 will contact to the stopper 43 and the conveyance of the sheet in the predetermined opposite direction will be regulated not to convey the sheet any more (as shown in FIG. 12). After the state shown in the FIG. 12, the sheet holding device 51 is operated and the rear end of the sheet S1 is pushed and held on the arranging support 41 by the pushing member 53 of the sheet holding device 51 (as shown in the FIG. 13).

Figure 13:
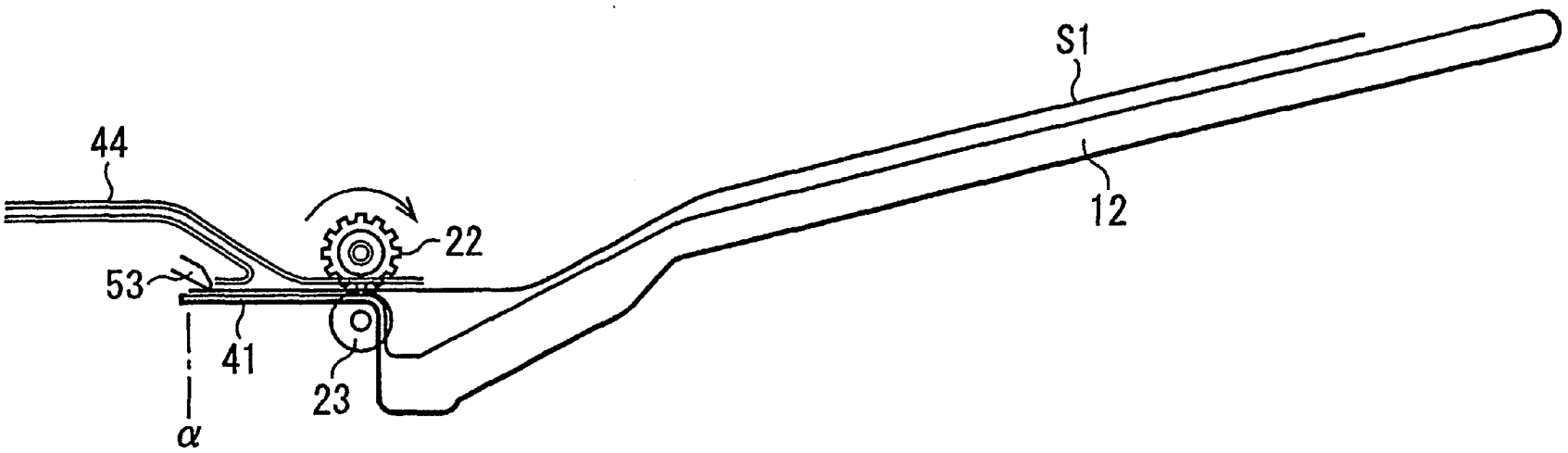
FIG. 13 is a simple side view of a paper conveyance state showing the state following FIG. 12.
Figure 14:
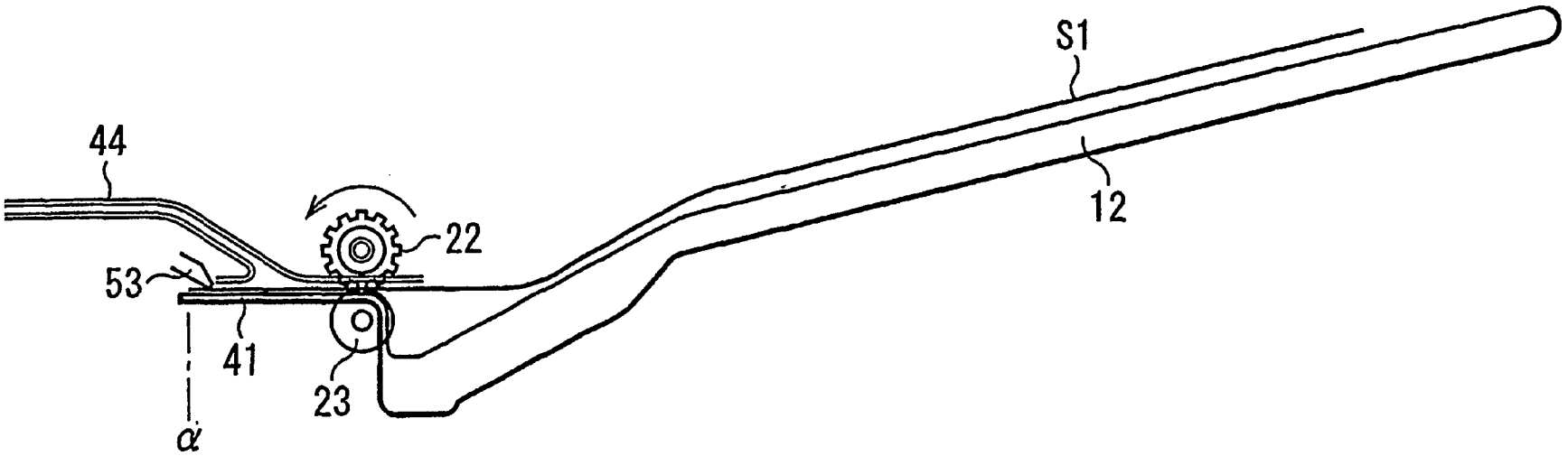
FIG. 14 is a simple side view of a paper conveyance state showing the state following FIG. 13.
Figure 15:
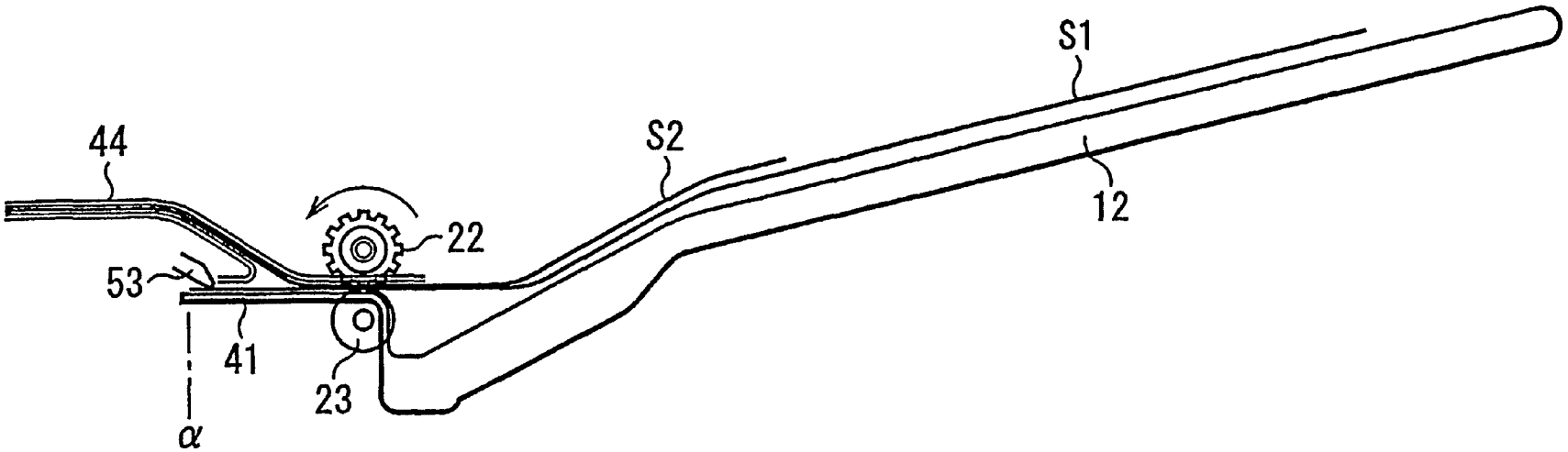
FIG. 15 is a simple side view of a paper conveyance state showing the state following FIG. 14.
Figure 16:
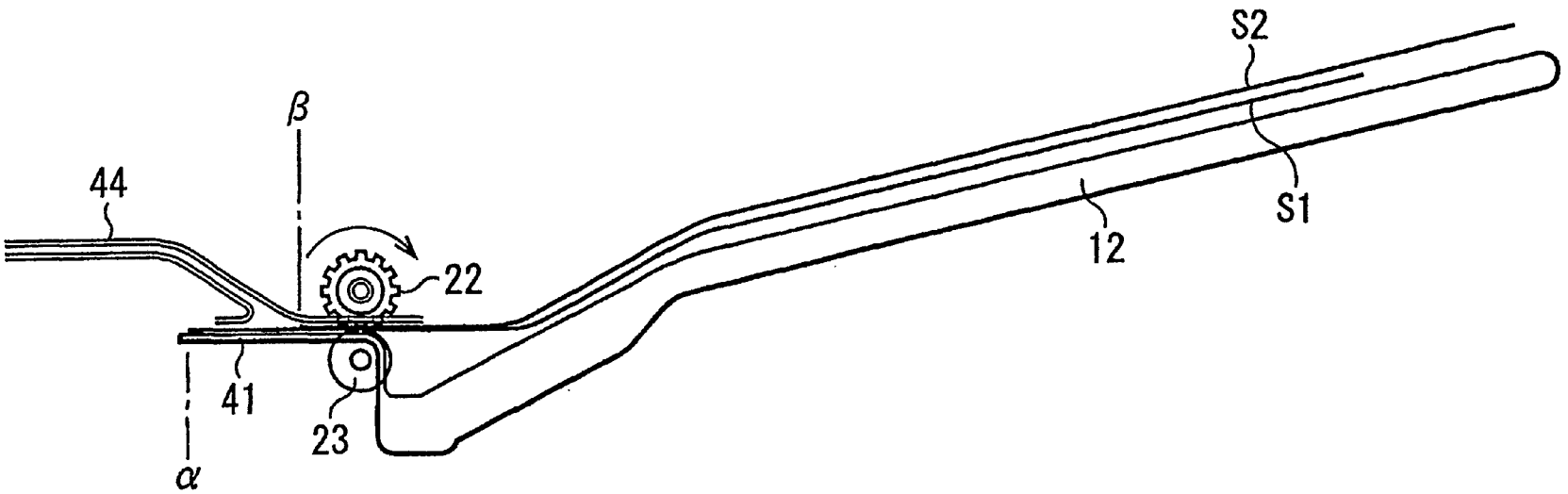
FIG. 16 is a simple side view of a paper conveyance state showing the state following FIG. 15.
Figure 17:
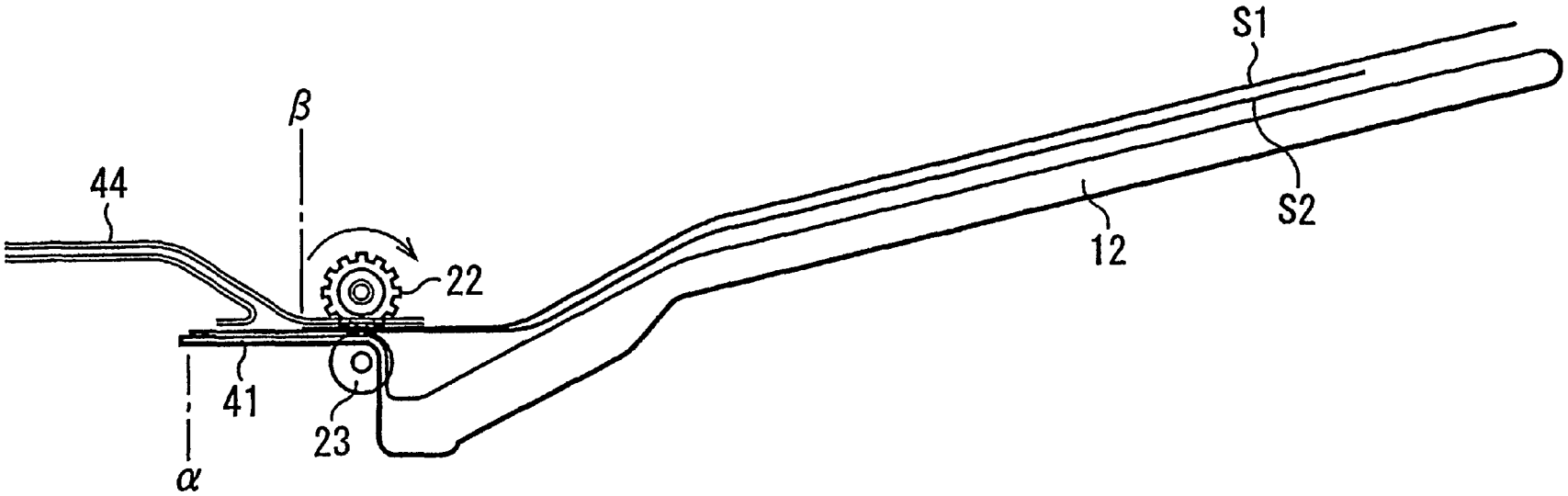
FIG. 17 is a simple side view of a paper conveyance state showing the state following FIG. 16.
Figure 18:
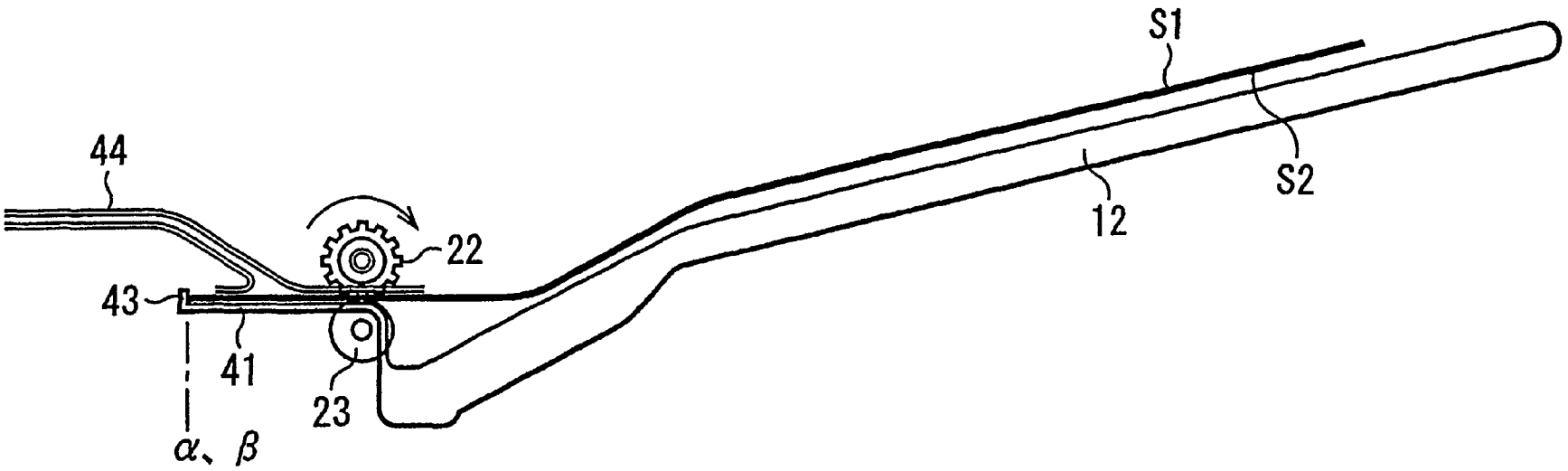
FIG. 18 is a simple side view of a paper conveyance state showing the state following FIG. 17.
Figure 19:
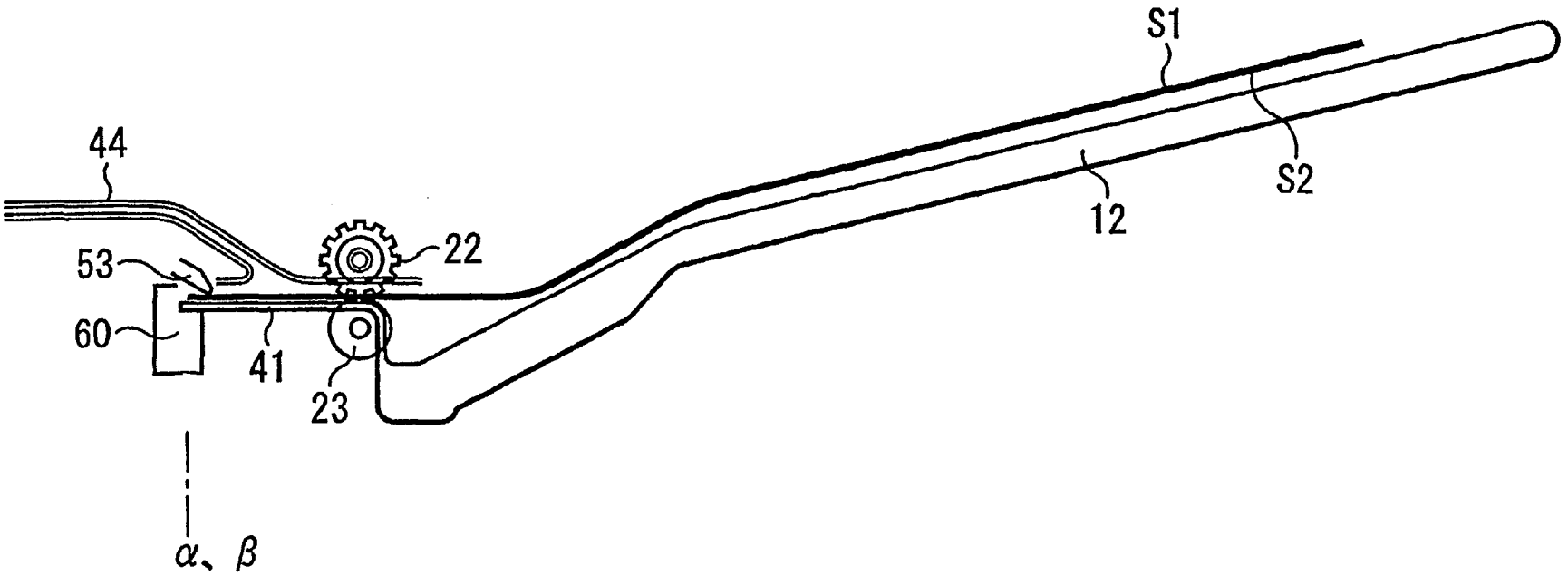
FIG. 19 is a simple side view of a paper conveyance state showing the state following FIG. 18.
Figure 20:
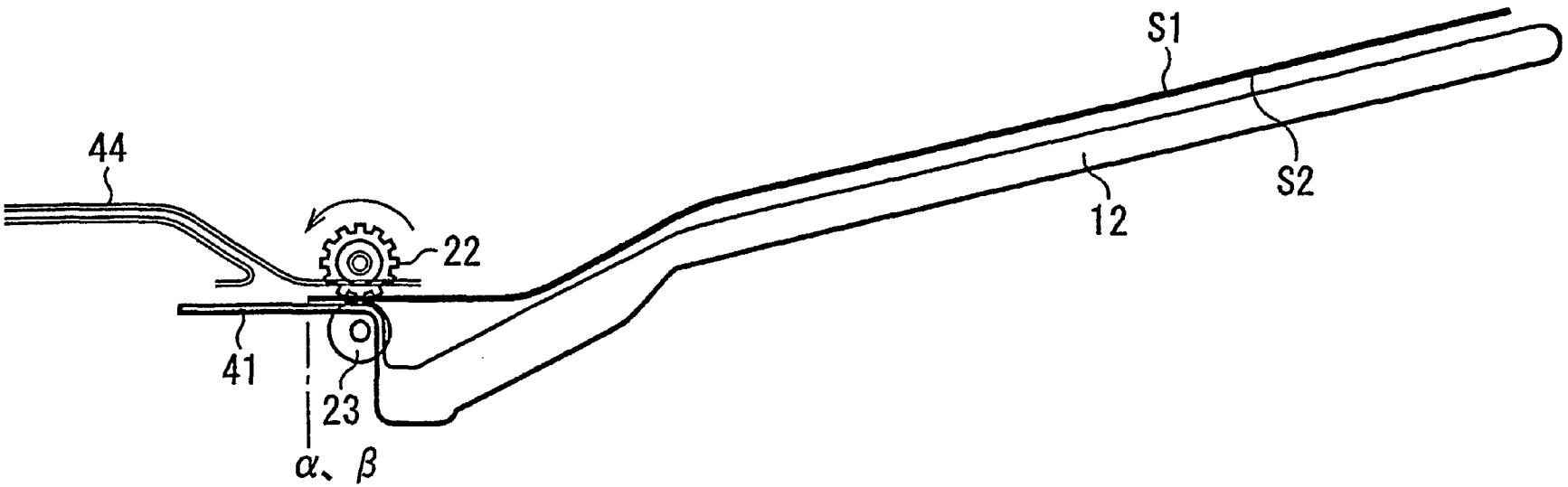
FIG. 20 is a simple side view of a paper conveyance state showing the state following FIG. 19.
Figure 21:
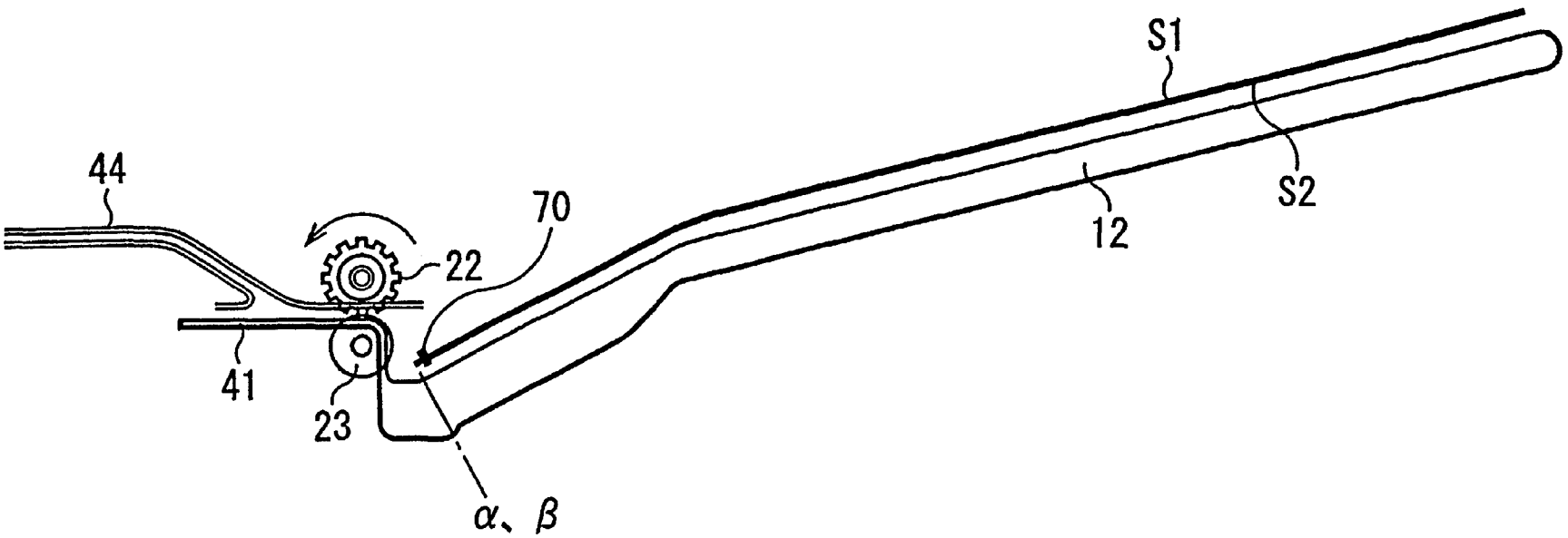
FIG. 21 is a simple side view of a paper conveyance state showing the state following FIG. 20.

From the state of the FIG. 13, the rotation of the driving roller portion 22 is switched to the rotation of the sheet discharging direction (as shown in the FIG. 14). The next sheet S2 is received by the discharging roller device 21 and is conveyed above the tray 12 (on the previous sheet S1), however, the previous sheet S1 is not conveyed and stands still on the arranging support 41, because the sheet S1 is held by the pushing member 53 (as shown in the FIG. 15). When the rear end of the sheet S2 reaches above the arranging support 41 by the conveyance of the sheet S2, the discharging roller device 21 starts to rotate in the reverse direction and the operation of the sheet holding device 51 is released so that the holding of the sheet S1 by the pushing member 53 is released (as shown in the FIG. 16). By the reverse rotation of the discharging roller device 21, the sheet S2 is conveyed to the predetermined opposite direction (as shown in the FIG. 17) and contacts the stopper 43 in a short time (as shown in the FIG. 18). The location of the rear end of the sheet S2 is marked as β in the figures.

The same operations will repeat for the following sheets. When the predetermined number of the sheets is arranged and piled on the arranging support 41, the discharging roller device 21 stops its rotation and the stapler 60 is operated to bind a sheet bunch together (as shown in the FIG. 19. The binding location is shown as the code 70 in the FIG. 21). After the binding operation, the solenoid 36 is energized so that the driving roller 25 having a large diameter is compressed as shown in the FIGS. 4 and 6 (or the ability of conveyance of the sheet or sheets is set to be larger). Then the discharging roller device 21 starts to rotate in the sheet discharging direction. The bunch is conveyed in the discharging direction to be discharged from the discharging roller device 21 and locates on the tray 12 at last (as shown in the FIG. 21).

Figure 22:
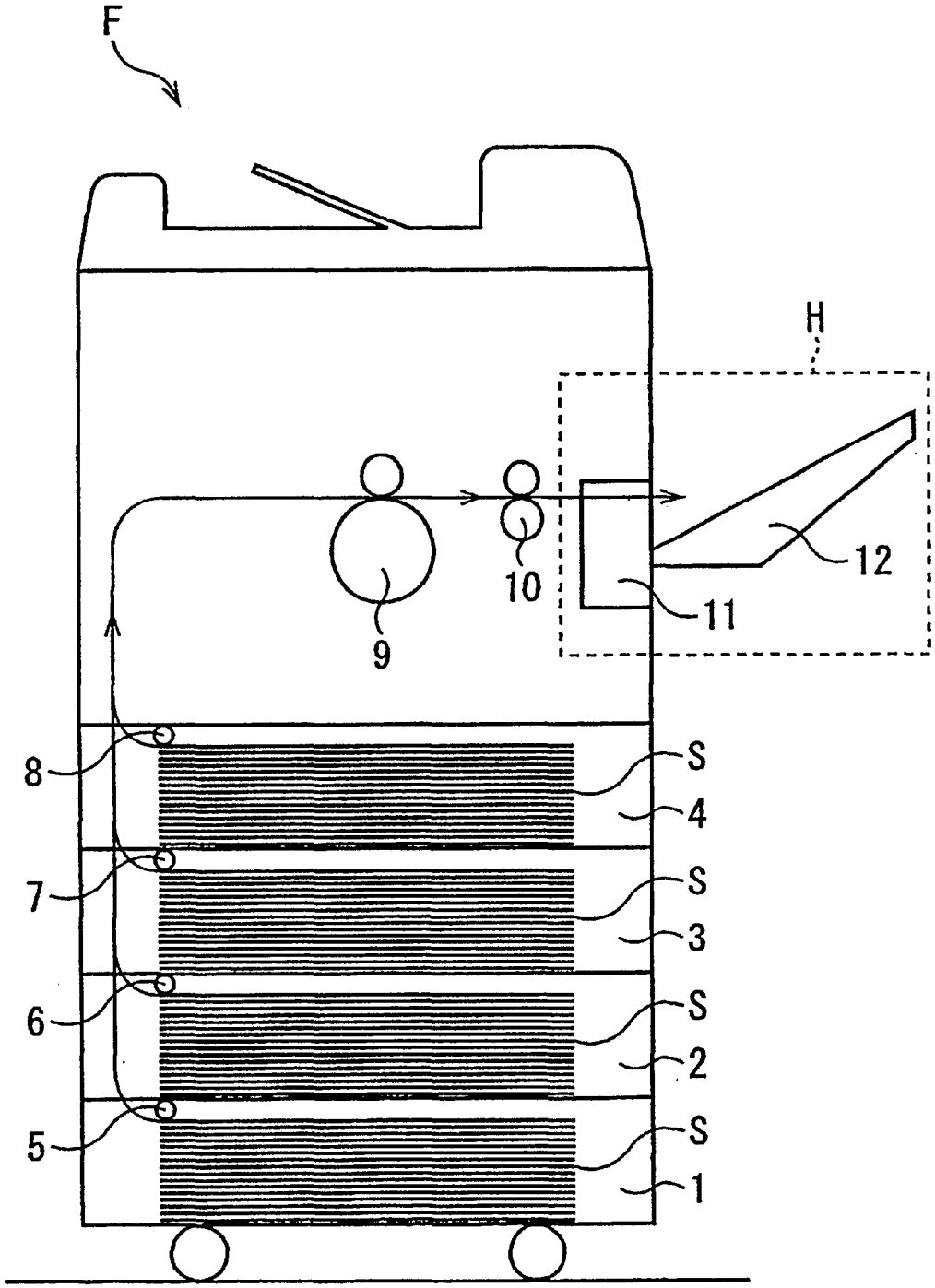
FIG. 22 shows another embodiment of an image forming device corresponding to FIG. 1.
Figure 23:
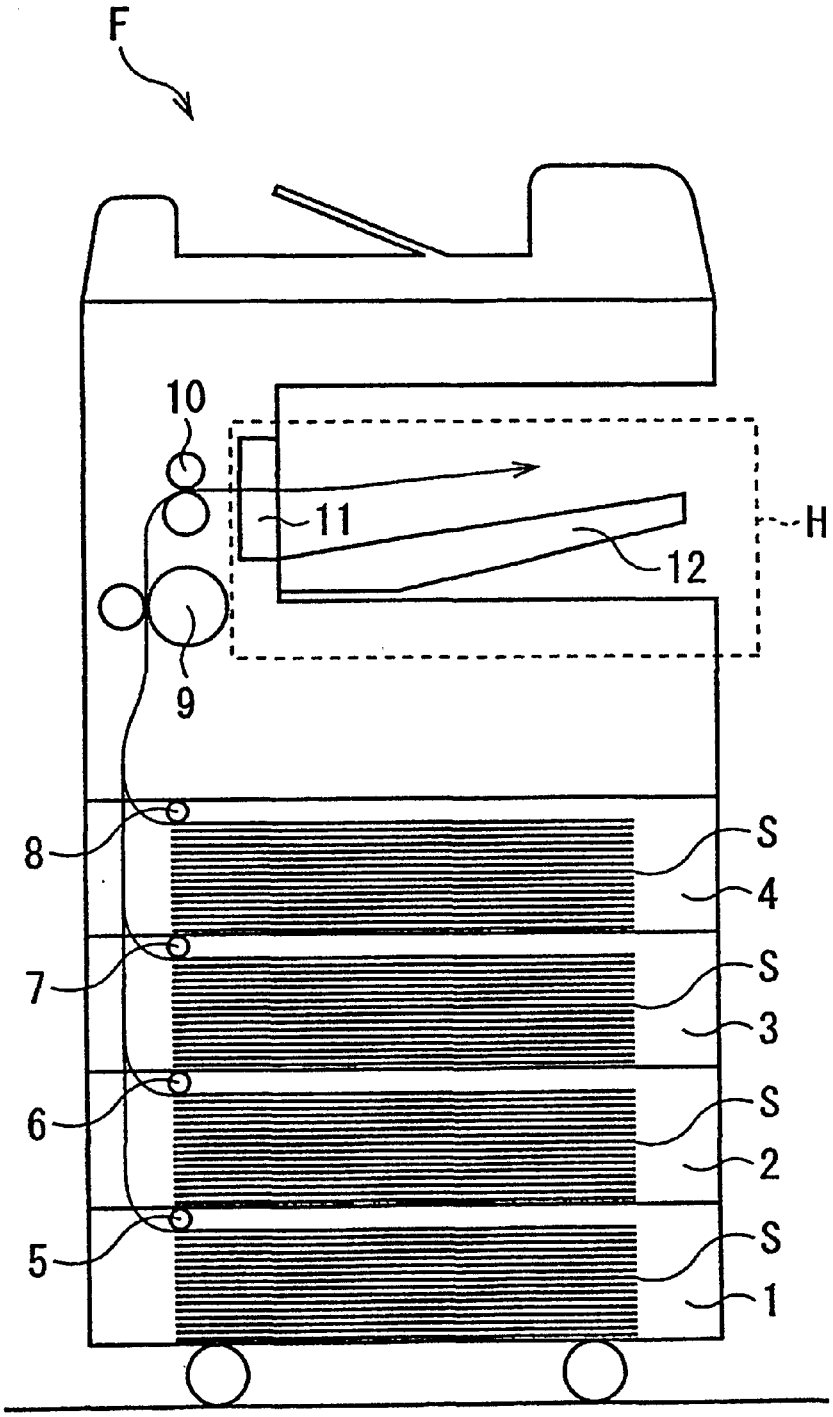
FIG. 23 shows another embodiment of an image forming device corresponding to FIG. 1.

The other two embodiments of this invention are respectively shown in the FIGS. 22 and 23. The FIG. 22 shows the embodiment that the sheet post-processing device H except the tray 12 is combined in the image-forming device F. The FIG. 22 shows the embodiment that the sheet post-processing device H and the tray 12 is combined in the image-forming device F.

Some embodiments are explained above. In the other embodiment, the conveyance means should not be limited to the roller conveyer, and the conveyance means can be composed of any other conveyers such as endless belts. A return spring biasing the driving shaft 24 upward can be equipped to help the roller 25 having a large diameter deform elastically from the compressed state shown in the FIG. 4 to the usual state shown in the FIG. 3.

INDUSTRIAL APPLICABILITY

This invention can make a sheet post-processing device for an image-forming device small and cheap, reduce the number of parts and provide a sheet post-processing device for an image-forming device having a high reliability.

What is claimed is:

1. A sheet post-processing device for discharging the sheets on a tray as a paper bunch after piling-up and positioning the received sheets comprising:

a conveyance means for conveying the sheets along the predetermined direction which is changeable;

a tray for arranging and loading a paper bunch; and a holding means for holding a paper bunch tightly;

wherein the holding means is operated when the conveyance means conveys the sheets in the paper discharging direction and is released when the conveyance means conveys the sheets in the paper taking-in direction.

2. The sheet post-processing device according to claim 1, further comprising a stapler binding the paper bunch loaded on said tray.

3. The sheet post-processing device according to claim 1, further comprising a sheet leading guide for guiding a sheet so that the input direction of the sheet to said conveyance means is slantwise from an upper portion to a oblique lower portion; and a sheet arranging table, on which the rear end of the sheet is temporarily located, approximately horizontally stretched from said conveyance means to the opposite direction against the sheet discharging direction;

wherein said holding means is set so as to hold the rear end of the sheet on said arranging table, and said conveyance means conveys the sheet led from said sheet leading guide once in the discharging direction, and in the opposite direction by reversing the conveyance direction in the state that said sheet can be conveyable so that the rear end of the sheet is located on said arranging table or on the previous sheet on or above said arranging table.

4. The sheet post-processing device according to claim 3, wherein said arranging table has a stopper contacting the rear end of the sheet.

5. The sheet post-processing device according to claim 1, wherein said conveyance means is set to have a conveying ability of a sheet bunch as well as a conveying ability of a single sheet.

6. The sheet post-processing device according to claim 5, wherein said conveyance means has two types of conveying rollers equipped around a common rotating shaft, one type is a large roller having a large diameter and the other type is a small roller having a small diameter, and only the large roller is used to convey a sheet and both large and small rollers are used to convey a bunch of sheets.

7. The sheet post-processing device according to claim 6, wherein the material of said large roller is softer than that of said small roller.

8. The sheet post-processing device according to claim 6, wherein the difference between the diameters of said large and small rollers is more than twice of thickness of a bunch of the sheets to be arranged.

9. The sheet post-processing device according to claim 1, wherein said conveyance means having at least two types rollers made of different materials.

10. The sheet post-processing device according to claim 1, wherein said conveyance means can be located at two different positions, one position is located during discharging a bunch of sheets and the other is during arranging a sheet or sheets.

11. The sheet post-processing device according to claim 1, wherein said conveyance means contacts all sheets composing the bunch of sheets from receiving a sheet till discharging the bunch.

12. An image-forming device having the sheet post-processing device according to claim 1.

* * * * *